United States Patent [19]

Watt et al.

[11] Patent Number: 4,618,347

[45] Date of Patent: Oct. 21, 1986

[54] FUEL BRIQUETTES AND THEIR PREPARATION

[76] Inventors: George Watt, 17 Strand View Road, Ballycastle, Co. Antrim; George E. Young, 24 Rockfield Gardens, Moycraig, Mosside, Ballymoney, Co. Antrim, both of Northern Ireland

[21] Appl. No.: 690,491

[22] PCT Filed: May 4, 1984

[86] PCT No.: PCT/GB84/00151

§ 371 Date: Dec. 26, 1984

§ 102(e) Date: Dec. 26, 1984

[87] PCT Pub. No.: WO84/04534

PCT Pub. Date: Nov. 22, 1984

[30] Foreign Application Priority Data

May 10, 1983 [GB] United Kingdom ..... 8312742
Feb. 21, 1984 [GB] United Kingdom ..... 8404527

[51] Int. Cl.[4] ..... C10L 5/10; C10L 5/20

[52] U.S. Cl. ..... 44/16 F; 44/16 R

[58] Field of Search ..... 44/15 D, 15 E, 16 R, 44/16 F

[56] References Cited

U.S. PATENT DOCUMENTS

| | | | |
|---|---|---|---|
| 969,504 | 9/1910 | Trainer et al. | 44/16 F |
| 1,084,479 | 1/1914 | Platsch | 44/16 R |
| 1,596,239 | 8/1926 | Delzeit | 44/16 F |

FOREIGN PATENT DOCUMENTS

| | | | |
|---|---|---|---|
| 12613 | of 1911 | United Kingdom | 44/16 F |

*Primary Examiner*—Carl F. Dees
*Attorney, Agent, or Firm*—Todd S. Parkhurst

[57] ABSTRACT

A combustible shaped body or fuel briquette is prepared by forming an essentially homogeneous mixture of a particulate fuel material such as coal dust and a curable binder such as lignosulphonate plus sodium dichromate; adding to the mixture an agent such as sulphuric acid which causes or accelerates curing, in situ; and shaping the resultant composition before the binder has cured, e.g. in a briquetting press. Briquettes are produced which can be sufficiently cured for stacking and packing, within 1 hour.

21 Claims, No Drawings

FUEL BRIQUETTES AND THEIR PREPARATION

This invention relates to the preparation of combustible fuel materials, suitable for domestic or industrial heating, in briquette form. Fuels for these purposes are, for example, peat, lignite, bituminous coal, anthracite, charcoal and sawdust.

In the manufacture of fuel briquettes, it is known to use coal tar pitch as a binder with coal dust, so as to hold it together when shaped under pressure in a briquetting press. However, coal tar pitch is becoming scarce and hence expensive. Bitumen has been used as an alternative but, after mixing with the coal dust, it must be cooled quickly to prevent it forming into coke. Furthermore, briquettes incorporating pitch or bitumen are unsuitable for use in modern glass-fronted fires because the smoke emitted, on ignition, discolours and stains the glass. More particularly, they are totally unacceptable for use in so-called "smokeless zones", the demand for which is rapidly increasing, for environmental reasons and especially owing to the awareness of health hazards caused by the emission of smoke into the atmosphere.

Therefore, if coal tar pitch or bitumen is to be used in the production of briquettes for smokeless fuel from, for example, anthracite duff (dust), the briquettes have to be defumed in a slow heat process in which the smoke content is gradually burned off without charring the briquettes. This additional step adds considerably to the cost of manufacturing the briquettes.

Phenolic resins and pre-gelling starches have been used as binders but, again, a heating stage is required in the manufacturing process, in order to dry off the very high moisture content and to set the briquettes.

Further processes for manufacturing fuel briquettes are described in U.S. Pat. No. 2,922,705 and GB-A No. 1059679. In the former description, an organic acid such as acetic acid is added to particulate coal. The method described in the latter comprises mixing briquetting coal, urea, formaldehyde and spent sulphite lye, e.g. a lignosulphonate, before pressing and briquetting; the lye may be sufficiently acidic to catalyse urea-formaldehyde condensation, or an organic or inorganic acid may be added.

As a binder for fuel briquettes, lignosulphonates have been used both in a hot process (i.e. a process incorporating a heating stage), and also in a cold process. In the latter case, the briquettes produced have generally had very poor resistance to pressure or impact. In attempts to strengthen the briquettes, and as disclosed in GB-A No. 992155, sodium dichromate has been added to a coal/binder mix, but the resultant briquettes have very poor green strength and can be damaged or disintegrated easily for quite some time after formation. The result is that they cannot immediately be packed or stacked in piles, but must be carefully spread in very shallow layers and left to harden for days before they are sufficiently firm to withstand the abuse realistically to be expected during subsequent packing, stacking or transportation. It is generally the case that anthracite briquettes are too liable to disintegrate, for satisfactory commcerial use.

The gelling reaction between lignosulphonate and dichromate has been extensively studied. Hayashi et al., in one of a series of papers published in what appears to be the Journal of the Japan Wood Research Society, specifically 12 (1966) 300–305, report that lignosulphonate is oxidised by dichromate during gelling, and it is also suggested that Cr (VI) would be reduced to Cr (III) by vigorous heating or by treatment with a strong acid such as sulphuric acid. This report gives no suggestion that the lignosulphonate gel is of practical value, and concludes by stating that the gel hardens very slowly after formation, e.g. over at least two weeks.

DD-A No. 0049325 discloses that a water-insoluble gel can be obtained from lignin sulphonate and chromic acid or its salts, and claims the use of a waste chromic acid source. The "chrome-lignin" reaction is disclosed in "The Chemistry of Cement and Concrete", ed. Lea, Pub. Edward Arnold (Publishers) Ltd., 3rd. Ed., 539, and also that the nature of the gel can be controlled under certain conditions, e.g. by the addition of sulphuric acid and its influence on pH.

Surprisingly, it has now been found that combustible shaped bodies such as pellets and briquettes (a term which is used herein, for convenience) can be made quickly and simply, without the need for special pretreatment of fuel materials and without the need to wait for unacceptable lengths of time before the product has satisfactory strength for transport and use.

According to the present invention, a process for preparing a combustible shaped body comprises forming an essentially homogeneous mixture of a particulate fuel material and a curable binder; adding to the essentially homogeneous mixture an agent which causes or accelerates curing, in situ; and shaping the resultant composition before the binder has cured.

The fuel may be any of those suitable for domestic or industrial heating, e.g. as exemplified above. The fuel used in the invention is preferably coal, e.g. charcoal, bituminous coal or, most preferably, anthracite. The particles are preferably no more than 3 mm grit size (which means that some supplies are preferably crushed).

The curable binder may be conventional in briquetting particulate fuel material. It may be, for example, "spent sulphite lye" as described in GB-A No. 1059679, or it may be a material which can conveniently be termed a "lignosulphonate". The exact nature of a lignosulphonate, the material which is preferred for use in the invention, may determine the quality of the product, and some experiment may be necessary in order to determine that material which is most satisfactory under any given conditions. We have found, as will be apparent from the Examples, that a mixture of commercially-available lignosulphonates is satisfactory in those cases. The weight of lignosulphonate or other binder is preferably from 5 to 12, more preferably 6 to 8, % by weight of the fuel material which is used.

The binder may cure only on the addition of the cure-active agent. Alternatively, the essentially homogeneous mixture may comprise a binder which cures relatively slowly, the curing being accelerated by the addition of the cure-active agent. It is thought that a binder such as lignosulphonate is cured by oxidation, and it is preferred that the essentially homogeneous mixture includes an oxidising agent such as an alkali metal, e.g. sodium dichromate. The weight of dichromate is preferably from 20 to 35, and more preferably 25, % of the weight of lignosulphonate.

The mixture which is formed in the first step of the process of the invention may comprise components in addition to the particulate fuel material and the binder. The mixture preferably comprises water, as a medium through which other components can be dispersed, e.g.

in solution, essentially homogeneously. For example, a water-soluble component such as a dichromate may readily be dispersed in an aqueous system within or from which the essentially homogeneous mixture is formed. It is in fact best to add the binder to a fuel/water mixture. The mixture may contain more than 5, but the preferred range is from 2 to 10, more preferably 2 to 8, % by weight water, based on the weight of the fuel. The water content, at least when a lignosulphonate is the binder, is preferably at least half the weight of the effective binder, e.g. the minimum lignosulphonate content which provides a satisfactory binder.

The fact that the mixture may contain water means that the surface moisture associated with particulate coal, e.g. anthracite duff, as supplied, need not be removed; such moisture may provide part or all of the water desired in the essentially homogeneous mixture. It is preferred that the particulate fuel material has a moisture content of no more 15, and often no more than 12, % by weight. However, by careful choice of conditions, it may be possible to adapt the process of the invention to produce briquettes of materials with a high inherent water content, e.g. peat, lignite or sawdust, with no or only partial pre-drying. It may be necessary to ensure that excess water is removed during the course of the process, e.g. during or after the formation of the essentially homogeneous mixture, or after addition of the cure-active agent; the addition of the cure-active agent may of itself cause loss, e.g. evaporation, of water.

The cure-active agent which is added to the essentially homogeneous mixture, in the second step of the process of the invention, may be such that it reacts with a component of the mixture. The agent may be a Lewis or other acid, examples of suitable Lewis acids being copper and aluminium compounds such as the respective chlorides and sulphates. If the addition of the agent causes an exothermic reaction, in situ, this may contribute to the removal of excess water and fast drying of the products formed on shaping. For environmental reasons, it is also satifactory if addition of the agent (or indeed any other step taken during the process) causes conversion of Cr (VI) to Cr (III).

The preferred cure-active agent is sulphuric acid. It may be in concentrated or aqueous form. Battery strength (30:70) or more concentrated (50:50) aqueous sulphuric acid is often suitable. A relatively concentrated acid may be preferred if the essentially homogeneous mixture to which it is added has a high moisture content. If aqueous acid is used, it is desirable not to dilute it immediately before its addition to the essentially homogeneous mixture, because the immediate exothermic heat may make the resultant briquettes too brittle. The amount of sulphuric acid used, calculated as $H_2SO_4$, is preferably from 0.3 to 2, e.g. 0.5 to 1, % by weight, based on the weight of the fuel material.

In the third step of the process of the invention, the composition formed on addition of the cure-active agent is shaped before the binder has cured. In order to avoid localised curing, it is preferred that the composition should be kept thoroughly mixed during the addition of the agent and up to the point of shaping.

As has been suggested above, the presence of water in the essentially homogeneous mixture facilitates good dispersion of the components, and also the efficient blending of the fuel material and the binder. We believe that water may also influence the rate of the initial setting of the green bond so that the, say, coal dust and binder can be thoroughly and vigorously mixed and fed to a briquetting press while still pliable. On exiting from the press assembly, the briquettes can be remarkably firm such that, if desired, they may be directed into sacks or, for example, manually shovelled and conveyed away from the press.

It is important that the cure-active agent should not cause instantaneous curing of the binder, but it is a preferred feature of the invention that a briquette can be formed by shaping, with satisfactory green strength, because the curing reaction is substantially complete within from 60, and often within 30, minutes from the addition of the cure-active agent. By "substantially complete", we mean that, in the given period, briquettes produced by the process of the invention are at least self-supporting, and cannot be crushed under a weight of 50 kg. In other words, within an hour, the briquettes can have resistance to both pressure and impact which is such that they can readily withstand abuse of bulk movement and stacking. Although curing can continue, with further increases in strength for two days or more after formation, it is the early strength of the briquettes which is of particular value in the practical operation of the process.

By way of example, in which coal dust, lignosulphonate, dichromate and sulphuric acid are given for the purposes of illustration only, the process of the invention may be conducted by first forming a slurry or other aqueous composition of part of the lignosulphonate in water, vigorously mixing the slurry with a dry mix of coal dust and the remaining lignosulphonate (without drying the dust), adding dichromate before or, preferably, after the dry mix and aqueous composition are mixed, and then spraying on sulphuric acid. Alternatively, but less preferably, because curing may be too fast, the dichromate may first be added simultaneously with the sulphuric acid.

These steps of the illustrative process may in fact be most simply operated by first mixing any extra water which may be desired with the dust, e.g. for 5 to 10 minutes. The lignosulphonate is then added, and mixed in for from 10 to 30 minutes, depending on the degree of balling in mixing. A stable mixture may be obtained, at this stage. Sodium dichromate is then added, with vigorous mixing, e.g. for from 5 to 60 seconds, and the acid is then sprayed on while continuing the mixing.

On application of the acid, a reaction, and exothermic heat, are apparent within seconds. Depending on the ambient conditions, it may be desirable to heat or insulate the mixer, to prevent or reduce heat loss. Ambient conditions, with temperatures from 5 to 30 C, are satisfactory. It is particularly desirable that vigorous mixing should be maintained during both the dichromate and sulphuric acid additions. The necessary degree of mixing can be achieved by using a flail mixer. The curing mixture is then briquetted.

The process sequence can, of course, be timed to operate on an in-line continuous basis for bulk production. In an illustrative sequence using the illustrative materials, anthracite duff passes up an elevating conveyor and is discharged into a crushing machine feed hopper. The duff is crushed and then conveyed by a belt conveyor via diverter valves into separate storage bins. The crushed duff is taken from one or more bins, as desired, and conveyed by a belt conveyor to a weighing unit storage hopper. The duff is weighed into predetermined amounts and conveyed by a further conveyor into a pre-mixing chamber where water is added to an automatically-controlled level. Lignosulphonate stored in a feed hopper is then introduced via a further belt elevator into the pre-mixer, and the essentially homogeneous mixture of duff and lye is allowed to pass from the pre-mixer, via a further belt elevator, into a pre-mix holding hopper. A rotating arm conveys the mixture onto a belt conveyor over which is positioned a gate which diverts into a further hopper, via a shute, an amount of the mixture determined by a weight sensor which then causes the gate to open and undiverted mixture to be passed down the belt conveyor and recycled to the pre-mix holding hopper. The pre-determined amount of mixture in the hopper passes to a final mixer in which vigorous mixing is maintained while dichromate and then acid are added. The curing mixture passes via a further belt conveyor to a briquetting press which conveniently comprises opposed rotating rolls having suitably shaped indentations which determine the shape and size of the briquettes.

The briquettes fall or are ejected from the rolls and pass along an extended enclosed conveyor, the exit of which co-operates with a conveyor-type bagging machine so that the briquettes are packed directly into sacks. Alternatively, the briquettes are deposited on a conveyor belt which moves them to an initial storage bin from which they may be removed by, for example, mechanical shovels after approximately one hour, and then stacked in large bulk containers or mounds.

The advantages and desirable features of the present invention may be summarised as the avoidance of need for pre-drying moisture-containing particulate fuel, fast curing of the briquettes, and their easy ignition, strength and water-resistance. Further, the briquettes retain their shape on burning, meaning that there is no fall-through in, say, a domestic grate.

The following Examples illustrate the invention. All parts are by weight.

EXAMPLE 1

5 parts lignosulphonate are dry-mixed with 100 parts anthracite duff (3 mm and under grit size) having a moisture content of 4% by weight. 5 parts lignosulphonate are mixed with 5 parts water to form a slurry. 2 parts sodium dichromate are added to, and mixed into, the slurry. The dry mix is vigorously mixed with the slurry, and then 3 parts sulphuric acid (battery strength) are sprayed onto the resultant mixture. An exotherm is immediately apparent.

The reacting mixture is passed to a press assembly, in which briquettes are pressed out. The briquettes have satisfactory resistance to both pressure and impact within one hour. At the same stage, briquettes selected at random and thrown against a brick wall from a distance of approximately 4.5 m, did not fracture.

EXAMPLE 2

The procedure of Example 1 is followed, except that the total amount of lignosulphonate is reduced to 6 parts per 100 parts anthracite dust.

EXAMPLE 3

2 parts powdered calcium lignosulphonate are mixed with 100 parts anthracite duff in a mixer. 8 parts aqueous ammonium lignosulphonate (comprising 4 parts dry ammonium lignosulphonate and 4 parts water) are added to the mixer, with further mixing, followed by 1.5 parts sodium dichromate. After mixing to form a homogeneous mixture, 3.5 parts aqueous sulphuric acid (50:50) are sprayed onto the mixture, and mixing is continued.

The mixture is fed by a screw to the feed pan of the briquette press, where briquettes are shaped and compressed to the desired size.

We claim:

1. A process for preparing a combustible shaped body, which comprises forming an essentially homogeneous mixture of particulate coal, 5 to 12% by weight lignosulphonate and 2 to 8% by weight water, the percentages being based on the weight of the coal; adding sequentially to the essentially homogeneous mixture from 20 to 35% by weight, based on the weight of the lignosulphonate, of an alkali metal dichromate, and then from 0.3 to 2% by weight of aqueous sulphuric acid, calculated as $H_2SO_4$ with respect to the weight of the coal; and shaping the resultant composition before the lignosulphonate binder has cured.

2. A process according to claim 1, in which the fuel material is anthracite duff.

3. A process according to claim 2, in which the fuel material is anthracite duff and the respective percentages of lignosulphonate, water, dichromate and sulphuric acid are 6 to 8, 1.5 to 3 and 1.5 to 2, the percentages being based on the weight of the coal.

4. A process according to claim 1 wherein the resultant composition comprises a "smokeless" briquette including a particulate fuel material and a binder which is the reaction product of a lignosulphonate, a dichromate and sulfuric acid.

5. A process for preparing a combustible shaped body, which comprises forming an essentially homogeneous mixture of a particulate fuel material, a lignosulphonate binder and water, in which the weight of water is 2 to 15% of the weight of the fuel material; adding to the essentially homogeneous mixture a dichromate as a cure-initiating component and, simultaneously or subsequently, aqueous sulphuric acid as a cure-accelerating agent; and shaping the resultant composition.

6. A process according to claim 5, in which the essentially homogeneous mixture contains from 5 to 12% by weight of the lignosulphonate, based on the weight of the fuel material.

7. A process according to claim 5, in which the weight of the dichromate is 20 to 35% of the weight of the lignosulphonate.

8. A process according to claim 5, in which the weight of sulphuric acid which is added, calculated as $H_2SO_4$, is 0.3 to 2% of the weight of the fuel material.

9. A process according to claim 5, in which the weight of sulphuric acid which is added, calculated as $H_2SO_4$, is 0.5 to 1% of the weight of the fuel material.

10. A process according to claim 5, in which the weight of the dichromate is 1.5 to 3% of the weight of the fuel material.

11. A process according to claim 5, in which the dichormate is sodium dichromate.

12. A process according to claim 5, in which the essentially homogeneous mixture comprises from 2 to 12% by weight water, based on the weight of the fuel material.

13. A process according to claim 12, in which the amounts of the binder, the cure-initiating component and the accelerating agent are respectively 5 to 12%, 1.25 to 4% and 0.3 to 2%, based on the weight of the fuel material.

14. A process according to claim 5, in which the essentially homogeneous mixture comprises from 2 to 10% by weight water, based on the weight of the fuel material.

15. A process according to claim 5, in which the cure-initiating component is homogeneously mixed with the essentially homogeneous mixture before addition of the accelerating agent.

16. A process according to claim 5, in which the cure-initiating component and the accelerating agent are added in quick succession to the essentially homogeneous mixture.

17. A process for preparing a combustible shaped body, which comprises forming an essentially homogeneous mixture of a particulate fuel material, the constituents for forming a chrome-lignin gel, and water, in which the weight of water is 2 to 15% of the weight of the fuel material; adding to the essentially homogeneous mixture, and mixing therewith, aqueous sulphuric acid as a cure-accelerating agent; and shaping the resultant composition.

18. A process according to claim 17, in which the essentially homogeneous mixture comprises from 2 to 12% by weight water, based on the weight of the fuel material.

19. A process according to claim 17, in which the essentially homogeneous mixture comprises from 2 to 10% by weight water, based on the weight of the fuel material.

20. A process according to claim 17, in which the fuel material is coal.

21. A fuel briquette which comprises a particulate fuel material and a binder which is the reaction product of a lignosulphonate, a dichromate and sulphuric acid.

* * * * *